US006117831A

United States Patent [19]

Chiang et al.

[11] Patent Number: 6,117,831

[45] Date of Patent: Sep. 12, 2000

[54] ALKALI METAL SALTS OF HYDROXYALKYL SULFONATES OF AMINOALKYL ALKANOL AMINES AND AMINOALKYL ALKANOL ETHERS AND METHOD OF MAKING SAME

[75] Inventors: Michael Yao-Chi Chiang, Flemington, N.J.; Daniel Wayne Lemke, Jersey Shore, Pa.; Joseph William Scheblein, Flemington, N.J.

[73] Assignee: Lonza Inc., Fair Lawn, N.J.

[21] Appl. No.: 09/146,880

[22] Filed: Sep. 3, 1998

[51] Int. Cl.[7] ..... C11D 1/18; C11D 1/75

[52] U.S. Cl. ..... 510/245; 510/237; 510/238; 510/424; 510/429; 510/503; 510/252; 510/272

[58] Field of Search ..... 510/237, 238, 510/245, 424, 429, 503, 252, 272

[56] References Cited

U.S. PATENT DOCUMENTS 4,214,102 7/1980 Leenders ..... 562/564

4,246,194 1/1981 Ferguson ..... 260/513

5,376,146 12/1994 Casperson et al. ..... 8/408

FOREIGN PATENT DOCUMENTS 421383 4/1991 European Pat. Off. .

*Primary Examiner*—Yogendra Gupta
*Assistant Examiner*—Charles Boyer
*Attorney, Agent, or Firm*—Darby & Darby

[57] ABSTRACT

The subject invention relates to a novel class of compounds, known as alkali metal salts of hydroxyalkyl sulfonates of aminoalkyl alkanol amines and/or aminoalkyl alkanol ethers, the methods of making such compounds, the alkali-stable solutions containing such compounds, and the use of said solutions as strong detergent compositions. Those alkali-stable solutions are temperature-stable, exhibit superior wetting characteristics, and can be made into low or high foam formulations useful for hard surface cleaning, oven and grill cleaning, metal cleaning, bottle washing, steam cleaning and wax stripping formulations.

8 Claims, No Drawings

ALKALI METAL SALTS OF HYDROXYALKYL SULFONATES OF AMINOALKYL ALKANOL AMINES AND AMINOALKYL ALKANOL ETHERS AND METHOD OF MAKING SAME

I. BACKGROUND OF THE INVENTION

The prior art predominantly describes amphoteric surface compounds that show no particular alkali stability. For example, sulfonic acid salts are the most common types of synthetic detergents described in the literature. Despite the fact that various synthetic surfactants exist for detergent applications, the need for acid- and alkali-stable surfactants remains.

The necessity for surface active agents that are stable in moderately strong alkali is discussed in U.S. Pat. No. 4,214,102. This patent teaches that many materials with amide linkages are destabilized in strong acids and alkalis, because that linkage readily breaks down in such media resulting in turbid solutions. The object of that invention is to develop amphoteric surface-active compounds that give a greater hydrophilic effect to the molecule and exhibit wide pH range stability from acidic to alkaline over long time periods. Those products are obtained by reaction of a glycidal ether with an excess of an N-hydroxy-$C_{2-4}$-alkyl-$C_{2-6}$-alkylene diamine and then N-alkylating the product with an excess of halo $C_{2-4}$ alkanoic acid or halo $C_{2-4}$ hydroxyalkane sulfonic acid.

Among the compounds produced are ones that have "the probable formulae":

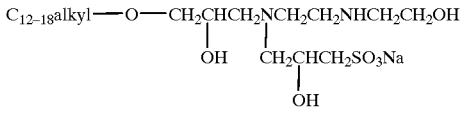

and

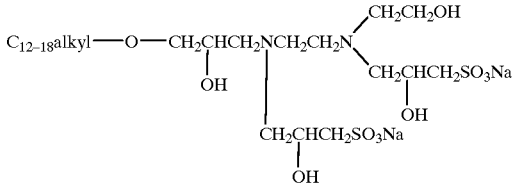

The products formed are shown to be good foamers and stable in both 20% sodium hydroxide and 20% sulfuric acid. However, the surface tension of 20% NaOH containing either 1% or 5% of the subject product was only reduced to 66.4 dyne/cm, indicating very poor surface activity in such a solution.

U.S. Pat. No. 3,839,318 describes the only commercial product that is stable in concentrated alkali solutions; it is sold under the trademark Triton BG-10 and comprises higher alkyl monosaccharides and higher oligosaccharides. Triton BG-10 is characterized by some deficiencies; namely, it is quite dark and viscous, has a burnt odor, only dissolves slowly in 50% NaOH, does not reduce the surface tension of 50% NaOH to any great extent, and produces foam.

U.S. Pat. No. 4,978,781 describes low-foam alkali-stable amphoteric surface active agents, including products of the formula:

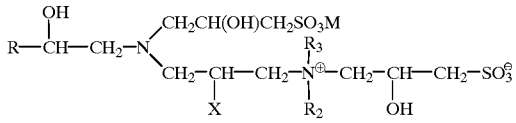

wherein R is selected from alkyl, aryl or alkylaryl groups of 4–18 carbon atoms or alkoxymethylene; wherein the alkoxy group contains 4–18 carbon atoms; $R_2$ and $R_3$ are individually selected from the group consisting of methyl, alkyl of 5–6 carbons, where said alkyl group is substituted by an electron-donating group on the beta carbon thereof, polyoxyethylene and polyoxypropylene; alternatively, $R_2$ and $R_3$ may together be $—CH_2CH_2OCH_2CH_2—$ or $—CH_2CH_2SCH_2CH_2—$ (i.e., together with nitrogen constitute a morpholine or thiomorpholine ring); M is hydrogen or an alkali metal cation; and X is hydrogen or an electron-donating group such as OH, SH, $CH_3O$ or $CH_3S$. Those products are said to be compatible with aqueous solutions containing up to 50% NaOH, appreciably reduce the surface tension of such solutions, remain dissolved when the concentrate is diluted with water to use concentrations of 5–20%, generate little or no foam in solutions containing 50% or less NaOH, and remain unchanged upon extended boiling of such solutions containing 5–20% NaOH.

II. SUMMARY OF THE INVENTION

The present invention is directed to a class of alkali metal salts of hydroxyalkyl sulfonates of aminoalkyl alkanol amines and/or aminoalkyl alkanol ethers (herein "sulfonates") useful as alkali-stable amphoteric surfactant wetting agents. These sulfonates may be prepared by the addition of a substituted aminoalkyl amine or aminoalkyl alkanol ether compound to an alkali metal salt of a halohydroxy alkyl sulfonic acid, an alkylating agent, at elevated temperatures between 50° C. and 100° C. in an aqueous environment.

Another aspect of the present invention is the discovery that the sulfonate surfactant compounds are fully soluble and stable in aqueous caustic solutions, such as those containing up to 50 wt. % NaOH. However, these solutions offered no performance advantages such as improved wetting. Solutions of this type have wetting times in excess of 10 minutes.

It has been discovered that these sulfonates and amine oxides form unique wetting agents (herein "wetting agent admixtures") which are also fully soluble and stable in aqueous 50% caustic solutions. Interestingly, the solubility of the amine oxides in caustic are enhanced by the addition of the sulfonate. Without the sulfonate, amine oxides are not soluble in highly concentrated caustic solutions.

In general, the wetting agent admixtures are clear light amber solutions, which maintain performance and color stability at 25° C. and after heating at 50° C. The wetting agent admixtures readily dissolve in concentrated caustic solutions and appreciably reduce the surface tension of the resultant solutions. Significantly, prolonging wetting time length allows those admixtures to more effectively penetrate surfaces to be cleaned. Typical wetting times of caustic admixtures of the present invention were found to be 32 sec. at 25° C. and the performance advantages remained after heating to 50° C.

A further improvement of the present invention is that low or high foaming compositions or formulations may be produced depending on the amine oxide used. In such cases, the sulfonate/amine oxide weight ratio is from 80:20 to 90:10, preferably 85:15.

The wetting agent admixtures in concentrated alkaline solutions remain dissolved when those solutions are further diluted with water to normal use concentrations. Dilutions of those caustic solutions is generally from 1:10 to 1:50 ratio, preferably about 1:20 ratio.

The caustic solutions of the invention, alone or in combination with an amine oxide, in aqueous form may also contain conventional additives. These include lower alcohols of 1–6 carbons, glycols, glycol ethers, chelating agents, and thickeners such as amides, cellulose derivatives and polyacrylates. In some cases, additional anionic, nonionic or amphoteric surface agents may also be present.

The caustic solutions of the present invention may be used as heavy duty cleaning agents. Such compositions typically include formulations for heavy duty cleaning agents for hard surface cleaners, oven and grill cleaning, metal cleaning, bottle washing, steam cleaning and wax stripping applications.

III. DETAILED DESCRIPTION OF THE INVENTION

All patents, patent applications, and literature references cited in the specification are hereby incorporated by reference in their entirety.

The Sulfonates of the Invention

The sulfonate surfactants of the present invention may be represented by two general formulas. Formula (I) is as follows:

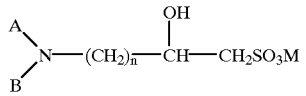

wherein A and B may be hydrogen, a straight or branched hydroxy aliphatic, amino aliphatic, hydroxylated amino aliphatic, or alkoxylated amino aliphatic group; wherein any one of the amino hydrogens of the amino aliphatic, hydroxylated or alkoxylated amino aliphatic groups may be substituted with $—(CH_2)_o—CH(OH)—CH_2SO_3M$ wherein o is 1 to 10; M is an alkali metal; and n is 1 to 3.

General Formula (II) is as follows:

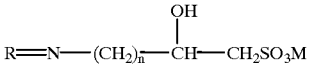

(II)

wherein R and N form a heterocyclic radical substituted with one or two ring nitrogen atoms; or a heterocyclic radical having up to one ring oxygen atom; M is hydrogen or an alkali metal; and n is 1 to 3.

Examples of straight or branched hydroxy aliphatic groups include, but are not limited to, methylol, ethylol and isopropylol.

Examples of straight or branched amino aliphatic groups include, but are not limited to:

$—CH_2N\underline{H}_2$
$—CH_2CH_2N\underline{H}_2$
$—CH_2CH_2N\underline{H}CH_2CH_2NH_2$
$—(CH_2CH_2N\underline{H})_mCH_2CH_2N\underline{H}_2$ wherein any one of the underlined amino hydrogens may be substituted with $—(CH_2)_o—CH(OH)—CH_2SO_3M$; and wherein M is hydrogen or an alkali metal, m is 1 to 4, and o is 1 to 10.

Examples of straight or branched hydroxylated amino aliphatic groups include, but are not limited to:

$—CH_2N\underline{H}(CH_2)_pOH$
$—CH_2CH_2N\underline{H}(CH_2)_pOH$
$—CH_2CH_2N\underline{H}CH_2CH_2NH(CH_2)_pOH$
$—(CH_2CH_2N\underline{H})_mCH_2CH_2N\underline{H}(CH_2)_pOH$
$—CH_2CH_2N[(CH_2)_pOH]_2$
$—CH_2CH_2N[(CH_2)_pOH]_3{}^+X^-$
$—CH_2CH_2N[(CH_2)_pCH(OH)CH_3]_2$ $—CH_2CH_2N[(CH_2)_pCH(OH)CH_3]_3{}^+X^-$ wherein X is chlorine, bromine or iodide and any one of the above-underlined amino hydrogens may be substituted with $—(CH_2)_o—CH(OH)—CH_2SO_3M$; and wherein M is hydrogen or an alkali metal, m is 1 to 4, o is 1 to 10, and p is 1 to 10.

Examples of straight or branched alkoxylated amino aliphatic groups include, but are not limited to:

$—CH_2CH_2NH(CH_2)_q—$O-alkoxy;
$—CH_2CH_2N[(CH_2)_q—$O-alkoxy$]_2$; and
$—CH_2CH_2N[(CH_2)_q—$O-alkoxy$]_3{}^+X^-$;

wherein X is chlorine, bromine or iodide; and q is 1 to 4.

Examples of O-alkoxy radicals include, but are not limited to, methoxy, ethoxy, n-propoxy, iso-propoxy, n-butoxy, isobutoxy and sec-butoxy.

Examples of some of the preferred compounds of Formula (I) are:

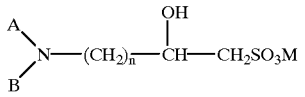
| Amino Sulfonate based on: |
|---|
| Ethylenediamine |
| Di-ethanol |
| Tri-ethanol |
| n-Propanol |
| Di-propanol |
| Tri-propanol |
| Mono isopropanol |
| Di-isopropanol |
| Tri-isopropanol |

-continued

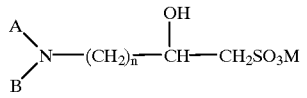

Amino Sulfonate based on:

Alkoxy ethoxylated

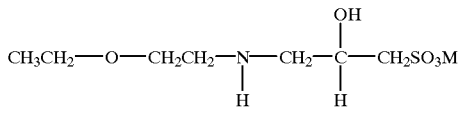

According to one preferred embodiment of this invention, A and B of Formula (I) may be hydrogen, —$CH_2CH_2$—OH, —$CH_2CH(OH)$—$CH_3$, —$CH_2CH_2$—$NH_2$, —$CH_2CH_2$—NH—$CH_2CH_2$—OH or —$CH_2CH_2$—$OCH_2CH_3$.

The most preferred compounds of Formula (1) of this invention are wherein: A is HO—$CH_2CH_2$—NH—$CH_2CH_2$; B is hydrogen; M is an alkali metal cation, most desirably sodium; and n is 1.

Examples of the preferred compounds of Formula (II) are piperazinyl, morpholine, and N and C substituted derivatives thereof wherein the substitutions are lower alkyl, hydroxyalkyl, or hydroxyaminoalkyl.

The most preferred compounds of Formula (II) of this invention are the salts of N-hydroxyethyl piperazine-N'-2-hydroxypropyl sulfonic acid, piperazine-N,N'-2-hydroxypropyl sulfonic acid (dihydrate), 3-(N-morpholino)-2-hydroxypropyl sulfonic acid, and 3-[N-(bis-cyclohexyl)-amino]-2-hydroxypropyl sulfonic acid. The preparation of the acids of these compounds is shown in Examples 3, 4, 6, and 8 of U.S. Pat. No. 4,246,194.

Preparation of the Sulfonates

The sulfonate surfactants of the invention may be prepared by first combining epichlorohydrin with sodium metabisulfite in water at elevated temperatures between 50° C. to 100° C. in an aqueous environment by methods well-known in the art.

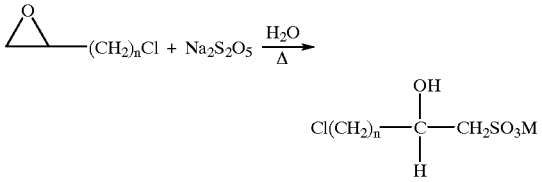

wherein n is 1.

The second step involves the addition of the substituted aminoalkylamine compound to the sodium salt of halohydroxyalkyl sulfonic acid:

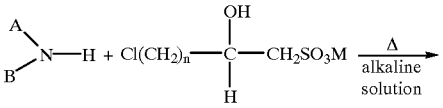

-continued

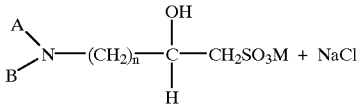

Preferably, the reaction is carried out at a temperature of from 60° to 100° C., at atmospheric pressure, in a solvent such as water and at a pH of from 8 to 10, most desirably 9.5. For making the mono-substituted compounds, the preferred molar ratio is from 1.04 to 2.5 moles of the sulfonate for each mole of the amine.

After the complete addition of the substituted amine, an alkaline pH within the range of 9–9.5 is maintained by the incremental addition of a concentrated NaOH solution, which may range from about 20% to 50%.

When chlorohydroxypropyl sulfonate is added to aminoethyl ethanol amine (AEEA) in a mole ratio of 1.2 to 1.0, the resulting product is a mixture of unreacted AEEA, mono-substituted, di-substituted, and tri-substituted AEEA. The approximate mole ratio of the first three components is 0.3:0.3:0.5. Some tri-substituted AEEA is also present. The ratio was calculated from elemental analysis after accounting for the free AEEA (by GC). The high content of di-substituted AEEA was confirmed in electroscopy-MS and 13C NMR spectra. There is also evidence of the tri-substituted AEEA. There was no evidence of substitution on the hydroxyl group. Therefore, these products (those with more than one nitrogen) are and will always be (given the synthetic process) mixtures of free amine, mono-, di-, tri-, etc. sulfonates.

The compounds of the present invention may also be in the form of a di-salt by combining the resultant substituted hydroxyalkyl sulfonates with a halohydroxypropyl sulfonate. For example, the reaction of the hydroxypropyl sulfonate of aminoethylethanol amine and 1-chloro-2-hydroxy propyl sulfonate forms a di-salt having the following formula:

$$HO—CH_2CH_2—NH—CH_2CH_2—N(CH_2CH(OH)CH_2—SO_3Na)_2.$$

The compounds of the invention also include quaternized compounds of Formula (I) and Formula (II). The basic nitrogen in each of those Formulas can be quaternized with lower alkyl halides, such as methyl, ethyl, propyl and butyl chloride, bromides and iodides. Water or oil soluble or dispersible products may be obtained by such quaternization.

Sulfonate Surfactant Compatibility with Aqueous Alkaline Solutions

The sulfonate surfactants of the present invention are soluble in up to 50 wt. % aqueous alkaline solutions, such as caustic solutions. In addition, the resultant caustic solutions remain phase-stable at 25° C. and upon heating to 50° C. for 24 hours. Upon dilution of a 50% caustic/sulphonate solution with ten parts of water (1:10), it was found to have a wetting time of greater than 10 minutes.

As discussed below, novel wetting agent admixtures were developed, wherein the unique ability of the sulfonate surfactants to solubilize amine oxide wetting agents in highly concentrated caustic solutions resulted in cleaning agents with enhanced wetting times.

Sulfonate Surfactant-Amine Oxide Admixture: Wetting Agent Compatibility with Aqueous Alkaline Solutions An admixture of these sulfonate surfactants with amine oxides were also found to be soluble in aqueous solutions of 40% to 50% caustic or equivalent. These admixtures were found to possess good wetting properties, while maintaining phase and performance stability. The sulfonate to amine oxide ratio in those solutions should be from a range of 95:5 to 80:20, with an optimal ratio being 85:15.

As noted above, the solubility of the amine oxides is enhanced by the addition of the sulfonate surfactants. Not all wetting agents can be successfully mixed with these sulfonates to form blends soluble in alkaline solutions. For example, other wetting agents, such as Lonzaine® CO or Aerosol® OTB, do not blend well with the sulfonates and mixtures thereof lack solubility, i.e., are unstable in 50% NaOH or highly caustic solutions.

The surface tension of the concentrated alkaline solutions containing the solubilized admixture of the present invention is appreciably reduced. This results in reducing wetting time length, which allows the admixture solutions to more effectively penetrate the surfaces to be cleaned.

Dilutions of the Concentrated Admixture-Caustic Solutions

The concentrated caustic containing the wetting agent admixture, i.e., the sulphonate and the amine oxide, is diluted with water to the desired use concentrations. Importantly, the components remain dissolved when these concentrated alkaline solutions are diluted. Dilutions are in a 1:10 to 1:50 ratio range, preferably in a 1:20 ratio.

Low or High Foaming Compositions

Compositions of the present invention may be produced that are low or high foaming depending on the amine oxide used. In such cases, the sulfonate/amine oxide ratio is from 80:20 to 90:10, preferably 85:15 ratio.

The low foaming surfactant is an amine oxide having the following structure:

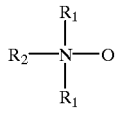

wherein the $R_1$ groups are independently selected from $C_1$–$C_4$ alkyl or alkoxy groups, and $R_2$ is a branched $C_{11}$–$C_{16}$ alkyl chain group. For $R_1$, methyl, ethyl, and hydroxyethyl are preferred and methyl is most preferred. For $R_2$, the branched $C_{12}$ and $C_{13}$ are preferred.

Specific examples of the preferred amine oxide surfactants for use in the novel formulations of the present invention include isononyldimethylamine oxide, isododecyidimethylamine oxide and isotridecyidimethylamine oxide. A particularly preferred non-foaming amine oxide is prepared using a branched alcohol having two to four branches, e.g., a typical chain length distribution of 6% $C_{10}$, 18% $C_{11}$, 55% $C_{12}$, 20% $C_{13}$, and 1% $C_{14}$ (the major isomer is trimethyl-1-nonanol.)

The high foaming surfactant is an amine oxide has the same structure as set for immediately above wherein $R_2$ is a straight chain $C_{10}$–$C_{16}$ alkyl chain group. For $R_2$, the straight chain $C_{10}$ and $C_{12}$ are preferred.

Specific examples of the preferred amine oxide surfactants for use in the foaming formulations of the present invention include n-decyldimethylamine oxide, n-dodecyldimethylamine oxide and isododecyldimethylamine oxide.

The aim of the above amine oxides can be synthesized by well known methods.

Components of Compositions of the Invention

Compositions of the present invention include the sulfonates alone or in combination with selected amine oxide, in aqueous NaOH or equivalent alkaline solutions, with or without conventional additives such as silicates, phosphates, pyrophosphates and polyphosphates for example in the form of the sodium salts. Other additives that may be present include lower alcohols of 1–6 carbons, glycols, glycol ethers, chelating agents, thickeners such as amides, cellulose derivatives and polyacrylates. In some cases, additional anionic, nonionic or amphoteric surface agents may also be present.

Uses of the Invention

The caustic solutions containing the wetting agent additive of the invention are useful as heavy duty cleaning agents for hard surface cleaners, oven and grill cleaning, metal cleaning, bottle washing, steam cleaning and wax stripping applications.

The present invention is illustrated by the following examples. These examples are intended to exemplify this invention, but not to limit its scope.

EXAMPLE 1

1-Chloro-2-Hydroxy Propane Sodium Sulfonate 580 grams (3.05 moles) of sodium metabisulfite and 1,572 ml of water were added to a five liter round bottom flask equipped with a mechanical stirrer, a vertical condenser and a temperature control unit. Reaction mixture stirred for approximately 30 minutes heated to 70° C. until the sodium metabisulfite had dissolved. 542.1 grams (5.86 moles) of epichlorohydrin was added dropwise at 70° C. over a 45 minute period to sodium metabisulfite-water mixture. The rate of epichlorohydrin addition was controlled to prevent an exotherm from rising above 85° C. This reaction was monitored by gas chromatography, as indicated by the disappearance of starting materials. The resulting reaction solution was used as is in the subsequent reaction.

Hydroxy Propane Sodium Sulfonate of AEEA 509.3 grams (4.89 moles) of AEEA were added dropwise over a one-hour period to the reaction solution. Reaction temperature was maintained between 80° C. to 85° C. at the completion of the AEEA addition and the pH of the reaction mixture was raised at 80° C. from 9 to 9.5 with a 50% solution of aqueous NaOH (240.5 grams, 3.01 moles). These conditions were maintained constant until the completion of the reaction. Approximately 4 hours after the complete addition of AEEA, the sodium chloride levels of the solution were determined to have reached its theoretically calculated weight % of 9.9%. This was an indication that the reaction had gone to completion. The final product contained 52% solids, had a pH at 10% active of 9.3, and had an amber clear liquid appearance.

EXAMPLE 2

Physical Properties as Wetting Agents

To demonstrate the efficacy of the instant invention, the hydroxy propane sodium sulfonate of AEEA (prepared as shown in Example 1) and an admixture of the sodium sulfonate of Example 1 and dodecyl dimethylamine oxide (85:15) were prepared. These were evaluated for solubility in 50% sodium hydroxide, temperature stability at 25° C. and 50° C., wetting ability and surface tension against Mirataine ASC (Rhone-Poulenc) CAS No. 108797-84-8 and 108797-85-9, a mixture of alkylether hydroxypropyl sultaines. This compound is a low foaming amphoteric wetting agent that is stable in 50% sodium hydroxide and described in U.S. patent Ser. Nos. 4,891,159 and 4,978,781.

For the comparison, the compounds were evaluated as wetting agents by Draves method SAPM No. 002-1-01; for surface tension by SensaDyne SAPM No. 010-1-01; and for accelerated oven aging by SAPM No. 012-1-01.

Results are shown in the following table:

TABLE 1

| Agent | Solubility* in 50% NaOH | Draves Wetting** sec. 25° C. | Draves Wetting** sec. After 24 hrs. @ 50° C. | Surface Tension** SensaDyne, dynes/cm after 24 hrs. @ 50° C. |
|---|---|---|---|---|
| Sulfonate of AEEA | 10 | >600 | >600 | 72 |
| 5436-191B*** | 10 | 32 | 32 | 41 |
| Mirataine ASC | 10 | 240 | 37 | 39 |

*Based on active surface active agent
**At 5000 ppm actives concentration
***A blend of 85% of 5342-147 and 15% of an amine oxide (Barlox ® 12, Lonza Inc.)

The foregoing data show that all compounds are soluble at 10% active ingredients in sodium hydroxide and that the Mirataine ASC showed superior wetting properties to the sulfonate by itself. However, the 85:15 admixture of sulfonate to amine oxide of the invention had substantially better wetting properties than the Mirataine ASC.

The superiority of the admixture is particularly significant in light of the lower cost for producing the admixture as compared to the Mirataine ASC. The cost estimated for the hydroxypropyl sultaine of AEEA would be between $0.55 and $0.60 a pound, whereas estimated cost for the Mirataine ASC would be approximately $2 a pound.

EXAMPLE 3

Comparison of the Physical Properties of Sulfonate/Amine Oxide Admixtures and Other Alkali Stable Surface Active Agents In order to further show the efficacy of the combination of the sulfonate compounds of the invention with amine oxide, tests were performed at different ratios using the cocoamine oxide (Barlox® 12, Lonza Inc.), the straight chain amine oxide; isododecylamine oxide (Barlox® 12i, Lonza Inc.), a branched chain amine oxide; and the cocobetaine (Lonzaine CO, Lonza Inc.), a straight chain betaine. These admixtures were compared with Mirataine ASC, and Mazon 40LF, a proprietary surfactant of PPG Industries containing 78% solids. The results are shown in Table 2.

TABLE 2

Experimental Alkali Stable Wetting Agent Phase Stability Results

| Phase Stability at 30 days | | | Ratio of Blend | Solubility in 50% NaOH at 30 days | | 1:20 dilution in DI water (1 part NaOH mix + 19 parts DI water) | |
|---|---|---|---|---|---|---|---|
| Description | 25° C. | 50° C. | to 50% Caustic | 25° C. | 50° C. | Draves, sec | S.T. dynes/cm |
| Sulfonate of AEEA | Good | Good | 20/80 | — | Good | >10 min. | — |
| Alkali Stable Wetting Agent High Foaming* | | | | | | | |
| 95/5 | Good | Good | 20/80 | Good | — | 317 | 54 |
| 85/15 | Good | Good | 20/80 | Good | Good | 30 | 42 |
| 75/25 | Good | Good | 25/75 | Good | Good | — | — |
| 70/30 | Good | — | 11/89 | slight haze | — | 21 | 42 |
| Alkali Stable Wetting Agent Low Foaming** | | | | | | | |
| 90/10 | Good | Good | 20/80 | Good | *** | — | — |
| 85/15 | Good | Good | 20/80 | Good | *** | 95 | 46 |
| 70/30 | Good | Good | 20/80 | 2ϕ, 25° C. 10 min. | — | — | — |
| Commercial Alkali Wetting Agent | | | | | | | |
| Mirataine ® ASC | Good | — | 20/80 | slight ppt. day 4 | Good: darkness in 24 hrs. | 150 | 44<br>39 |
| Mazon ® 40LF | Good | — | 2/98 | black soln. | — | 29 (opaque) | 43 |
| Mazon ® 40LF | Good | — | 4/96 | black soln. | — | 8, 2ϕ 50° C. | 37 |

*Ratio of sulfonate of AEEA to straight chain amine oxide (Barlox 12)
**Ratio of sulfonate of AEEA to branched chain amine oxide (Barlox 12i)
***At 50° C. the solution separated into two phases. Upon cooling, the solution will return to a single clear phase.

Table 2 shows the results of phase stability (at 25° C. and 50° C.), solubility, wetting and surface tension tests of: (1) the identified sulfonate/amine oxide admixtures, in different ratios, in aqueous 50% NaOH solutions and (2) the dilution of the aforementioned samples in a 1:20 ratio with water. Those admixtures contain a sodium sulfonate of AEEA of the present invention, and a wetting agent selected from Barlox® 12, Barlox® 12i, Mirataine® ASC and Mazon® 40LF (PPG Industries Inc.).

In particular, the 85:15 blend of Barlox® 12 high foaming admixture and the 85:15 blend of Barlox 12i low foaming admixture were found to dissolve in a ratio of 20 parts of admixture to 80 parts of 50% NaOH, which can be further diluted with water in a 1:20 ratio to show good wetting properties of 30–32 sec. Moreover, wetting agents, other than Barlox® 12 and Barlox® 12i, did not blend well with the sulfonates due to lack of solubility or phase stability in 50% NaOH, even with heating at 50° C.

In addition, different types of commercial alkali wetting agents were admixed with the sulfonate of AEEA and tested for solubility therein. The mixtures were tested for solubility in caustic and their physical properties evaluated. The wetting agents are described in Table 3:

TABLE 3

Chemical Classes Other Than Amine Oxides Blended with Sulfonate of AEEA

| Chemical Class | Trade Name | Company |
|---|---|---|
| Betaine | Lonzaine CO | Lonza |
| Sodium dioctyl sulfosuccinate | Aerosol OTB | American Cyanamid |

TABLE 3-continued

Chemical Classes Other Than Amine Oxides Blended with Sulfonate of AEEA

| Chemical Class | Trade Name | Company |
|---|---|---|
| Sodium ether sulfate | Carsonol SES-S | Lonza |
| Sodium lauryl sulfate | Carsonol SLS-R | Lonza |
| Ethoxylated nonyl phenol | Carsonon N-9 | Lonza |

None of these admixtures met the criteria of an alkali wetting agent. These criteria include solubility in the sulfonate, solubility in 50% caustic, low wetting time, and low surface tension.

EXAMPLE 4

Performance Study of Alkali Wetting Agents

Samples containing an admixture of the sulfonate surfactants with Barlox® 12 (high foaming) and Barlox® 12i (low foaming), respectively, in aqueous 50% NaOH solution were studied for performance of surface tension, wetting time, blender foam at 25° C. and phase stability at 23° C., 40° C. and 50° C. A comparison between those samples and Mirataine ASC were made.

TABLE 4

Alkali-Stable Wetting Agents (ASWA): Low and High Foam Versions

| Performance | Lonza ASWA-HF | Lonza ASWA-LF | Mirataine ® ASC |
|---|---|---|---|
| Surface Tension, dynes/cm | 42 | 46 | 44 |
| Wetting Time, sec. | 30 | 95 | 150 |
| Blender Foam, initial/2 min. | 52/50 | 39/7 | 27/0 |
| Phase Stability in 50% NaOH @ 30 Days | | | |
| 23° C. | Good | Good | Good |
| 40° C. | Good | Good | Good |
| 50° C. | Good | Separated in <24 hrs.** | Separated on day 7* |

*Darkened in 2 hours.
**Sample became clear upon cooling to 25° C.

This chart indicates that the compounds of the invention are comparable to Mirataine® ASC with respect to surface tension and blender foaming. The ASWA-HF formulation of the invention had outstanding phase stability, with appreciably better wetting times.

EXAMPLE 5

Alkali Solubility of Sulfonates Based upon Various Amines

A variety of sulfonates were prepared following the procedure described in Example 1 and screened for their solubility (10 wt. %) in 50% caustic and solubility as a blend (80:20) with amine oxide in 50% caustic. This test is called a screening test because no attempts were made to optimize the blend ratio to improve the solubility.

The samples varied from each other in the type of amine used (i.e., AEEA, diethanol amine, ammonia, etc.) and mole ratio of alkylating agent, 1-chloro-2-hydroxy propane sodium sulfonate, to amine.

Table 5 shows that the caustic solubility of the sulfonate and the admixture of the sulfonate with amine oxide can be influenced by altering the amine substitution and the mole ratio of alkylating agent to amine. It also shows the claim of alkali solubility is broader than just sulfonates based upon AEEA and a mole ratio of 1.2 moles alkylating agent to 1.0 mole amine. In the case of the last four sulfonates in Table 5, the blends were not optimized for solubility.

We claim:

1. An aqueous surfactant composition comprising 30 to 50% of NaOH and an amount of the compound having a Formula (I):

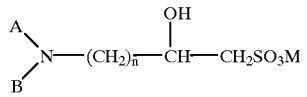

wherein A and B may be hydrogen, a straight or branched hydroxy aliphatic, amino aliphatic, hydroxylated amino aliphatic, or alkoxylated amino aliphatic group; wherein any one of the amino hydrogens of the amino aliphatic, hydroxylated or alkoxylated amino aliphatic groups may be substituted with $(CH_2)_o$—CH(OH)—$CH_2SO_3M$ wherein o is 1 to 10; M is an alkali metal; and n is 1 to 3;

or of a Formula (II):

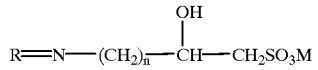

wherein R and N form a heterocyclic radical substituted with one or two ring nitrogen atoms; or a heterocyclic radical having up to one ring oxygen atom; M is hydrogen or an alkali metal; and n is 1 to 3, said compound present in an amount sufficient to impart surface activity to said composition.

2. An aqueous surfactant composition comprising an effective amount of an admixture of the compound of a Formula (I):

TABLE 5

Alkali Solubility of Hydroxyl Propyl Sulfonates

| Amine Type | Sample Number | M/R* (sulfonate/amine) | Solids Wt. % | Sodium Chloride Wt. % | Color (Gardner) | Solubility of Blend of Barlox 12 in Sulfonate at 15% | Solubility of Barlox/Sulfonate Blend in 50% NaOH at 20% |
|---|---|---|---|---|---|---|---|
| AEEA** | 25 | 1.2 | 50.7 | 9.0 | 3+ | Yes | Yes |
| Diethanol-amine | 26 | 1.2 | 53.4 | 9.5 | 1 | Yes | Yes |
| Monoiso-propylamine | 21 | 1.2 | 55.0 | 10.9 | 1 | Yes | Yes |
| AEEA | 13 | 2.0 | 55.5 | 11.2 | 1 | Yes | Yes |
| Ammonia | 27 | 1.2 | 48.8 | 10.8 | 1 | Yes | No |
| Monoethanol-amine | 17 | 1.2 | 53.5 | 11.2 | 1 | Yes | No |
| Ethylene-diamine | 14 | 1.2 | 54.0 | 11.6 | 3+ | Yes | No |
| Ethylene-diamine | 15 | 2.0 | 58.0 | 12.5 | 3.5 | Yes | No |
| Triethanol-amine | 18 | 1.2 | 53.4 | 9.2 | 1 | No | No |
| Diethylene triamine | 16 | 1.2 | 55.3 | 10.1 | 5 | No | No |
| Diisopropyl amine | 22 | 1.2 | 51.4 | 9.0 | 3+ | No | No |
| Triisopropylamine | 28 | 1.2 | 54.0 | 7.3 | 2 | No | No |

*M/R is the molar ratio of sulfoante to amine
**Sample is a duplicate of sample mentioned in Example 1

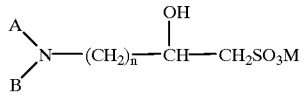

wherein A and B may be hydrogen, a straight or branched hydroxy aliphatic having from 1 to 3 carbon atoms, amino aliphatic, hydroxylated amino aliphatic, or alkoxylated amino aliphatic group; wherein any one of the amino hydrogens of the amino aliphatic, hydroxylated or alkoxylated amino aliphatic groups may be substituted with $(CH_2)_o$—CH(OH)—$CH_2SO_3M$ wherein o is 1 to 10; M is an alkali metal; and n is 1 to 3;

or of a Formula (II):

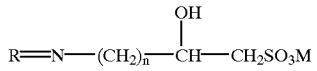

wherein R and N form a heterocyclic radical substituted with one or two ring nitrogen atoms; or a heterocyclic radical having up to one ring oxygen atom; M is hydrogen or an alkali metal; and n is 1 to 3, and an amine oxide, in a ratio of from 50:50 to 95:5 wherein the amine oxide has the following structure:

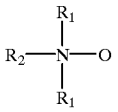

wherein the R, groups are independently selected from $C_1$–$C_4$ alkyl or alkoxy groups, and $R_2$ is a branched $C_{11}$–$C_{16}$ alkyl chain group.

3. The compound of claim 1, having the Formula (I) wherein A and B are selected from the group consisting of hydrogen, —$CH_2CH_2$—OH, —$CH_2CH(OH)$—$CH_3$, —$CH_2CH_2$—$NH_2$, —$CH_2CH_2$—NH—$CH_2CH_2$—OH and —$CH_2CH_2$—$OCH_2CH_3$.

4. The aqueous surfactant composition of claim 2, wherein said amine oxide is cocoamine oxide.

5. The aqueous surfactant composition of claim 2, wherein said amine oxide is isododecylamine oxide.

6. The aqueous surfactant composition of claim 1, wherein said composition is further diluted with water in a ratio of from 1:10 to 1:50.

7. The aqueous surfactant composition of 1, wherein said composition is further diluted with water in a ratio of 1:20.

8. A method for cleaning a hard surface which comprises applying to said hard surface an aqueous surfactant composition of claim 1.

* * * * *